US005390002A

United States Patent [19]

Michlin

[11] Patent Number: 5,390,002

[45] Date of Patent: Feb. 14, 1995

[54] TONER CARTRIDGE HOLDER PIN

[76] Inventor: Steven B. Michlin, 5310 Bentley Suite 105, West Bloomfield, Mich. 48322

[21] Appl. No.: 205,062

[22] Filed: Mar. 2, 1994

[51] Int. Cl.[6] ..... G03G 15/00

[52] U.S. Cl. ..... 355/200; 355/245

[58] Field of Search ..... 355/200, 210, 211, 133, 355/245, 260

[56] References Cited

U.S. PATENT DOCUMENTS 4,987,451 1/1991 Hikosaka et al. ..... 355/245

*Primary Examiner*—R. L. Moses

[57] ABSTRACT

An easily removable and reusable holding pin for securing together the sections of a toner cartridge assembly for use in imaging machines. The holding pin comprises a shank with a head structured to allow easy gripping of the pin by pulling tools. The head has a first portion wider than the shank which abuts against the wall of the assembly when the shank of the pin is inserted into the assembly to secure the sections together. The first portion separates the shank from a second portion of the head. The second portion is wider than the first portion of the head so it overhangs the first portion, providing a space between the second portion of the head and the assembly wall when the pin is installed in the cartridge assembly. The gripping parts of a tool may extend through this space to grip or otherwise contact the head of the pin, allowing the pin to be pulled from the assembly without damage to the pin or cartridge assembly.

9 Claims, 1 Drawing Sheet

TONER CARTRIDGE HOLDER PIN

BACKGROUND OF THE INVENTION

This invention relates to solving problems in Xerography and more specifically in the toner cartridge remanufacturing industry. This includes copiers, laser printers and facsimile machines which will be referred to as imaging machines.

CANON has designed an all-in-one cartridge as seen in Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing these cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1993 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the actual useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM(Original Equipment Manufacturer) drum. With the additional developments of drum coatings, originally designed for OEM drums, the long-life drum may last for many additional cycles. Some coatings, in theory, were designed to be dissolved and removed from over the drum surface every 1—3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartrides with longer cycles, so component improvements are significant. Therefore, avoiding natural problems with prevention means must also be implemented for cartridges of longer life both in longer cycle times and greater number of cycles. One good example is the holding pin used in the LX, FX, and BX Canon engine cartridge. They may be seen under other nameplates, such as HP, QMS, Pitney-Bowes, Canon Fax and so on, however the engine is manufactured by Canon.

The holding pin is used to hold the main cartridge components together. The pin used by the OEM manufacturer has an even diameter all the way around. To remanufacture the cartridge, this pin must be removed. Pin removal is among the very first steps. Pin removal, however, has been an industry-wide problem. Pin removal is not always clean. The reason it is not always a "clean" operation is because a very small portion of the pin sticks out. Such a small portion protrudes for 2 possible reasons. First, if it sticks out too far, the cartridge will not fit into the imaging machine. So it must be pushed in to a certain depth such that a maximum protrusion is allowed. Some remanufacturers have developed depth setting devices to avoid pushing the pin in too far. Others have developed tools for pin pulling. For example wire cutters of the nipper variety, "dikes" and flat wire cutters have been modified on a grinding wheel to pull these pins. Even with the best pin depth setter, the pin must be pulled on the first cycle. In the first cycle, the pin is usually pushed in further than desired. When the pin is successfully removed, it is generally scratched with score marks from the pin-removal process. Once the outer surface of the pin is scored, it becomes that much more difficult to remove. The wire cutters have no smooth surface to grab on to. Oftentimes, on the first cartridge cycle, the pin is so difficult to remove that the plastic cartridge case must be slightly modified or cut up, drilled, or otherwise deformed in order to remove it. Oftentimes, the pin is accidently pushed in too far after the first recharge cycle. In modifying the cartridge, the cartridge loses its factory-new look and usually even looks sloppy and unprofessional as well. In any event, the pin makes recharging these cartridge types a project rather than a straightforward task. With the easily removable pin device of this invention, pin removal is very easy to do.

SUMMARY OF. THE INVENTION

Accordingly, it is an object of this invention to provide an easily removable holding pin for use in securing toner cartridge assembly sections together.

Another object of this invention is to provide a holding pin with a head designed to be easily gripped so the pin may be quickly and efficiently removed from the assembly by typical pin pulling tools used in the cartridge remanufacturing industry.

A further object of this invention is to provide a holding pin which may be quickly inserted to the proper depth within the toner cartridge assembly.

A still further object of this invention is to provide a holding pin which may be inserted into and removed from the assembly again and again through many remanufacturing cycles without damage to the pin or assembly.

In carrying out this invention in the illustrative embodiment thereof, a holding pin is disclosed which has a shank and a head designed to be easity pripped by a conventional pulling tool. The head has two portions. The first portion is between the second portion and the shank and is for abutting against the assembly wall, enabling the shank to be inserted into the assembly to the exact required depth needed to secure the sections of the cartridge assembly together. The second portion of the head is wider than the first portion so it overhangs the first portion and provides a space through which a surface of the pin may be easily gripped or contacted by the pulling tool.

BRIEF DESCRIPTION OF THE DRAWINGS

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
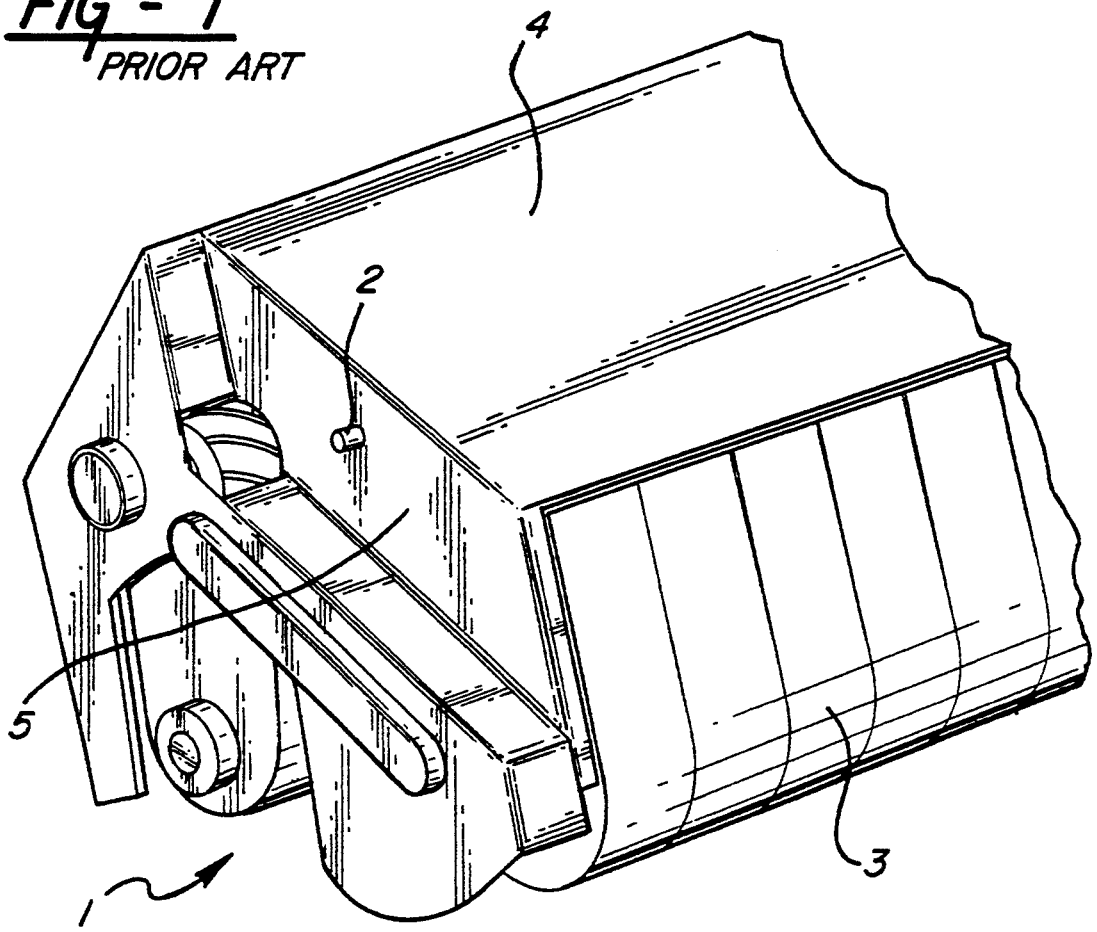
FIG - 1 PRIOR ART
FIG. 1 shows part of a conventional toner cartridge assembly with sections held together by a holding pin.

FIG. 1 shows a conventional toner cartridge assembly 1. When remanufacturing the assembly 1 so it may be used again after the original supply of toner is used up, the toner cartridge assembly 1 needs to be taken apart for the purposes of refilling the toner hopper and replacing worn or broken parts. A holding pin 2 at each end of the assembly 1 holds or secures two sections of the toner cartridge assembly 1 together. A first section 3 includes among its components the toner hopper. A second section 4 includes the photoreceptor drum and .waste toner hopper.

Figure 2:
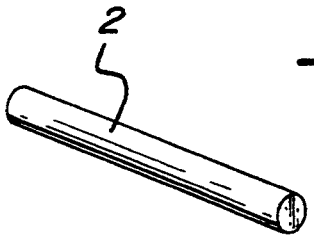
FIG - 2 PRIOR ART
FIG. 2 illustrates a prior art holding pin.

The prior art holding pin 2 is shown more completely (and slightly enlarged) in FIG. 2. The pin 2 is difficult to remove from the assembly 1. When it is removed by wire cutters, for example, it is usually scratched or otherwise deformed. Sometimes the plastic cartridge case assembly wall 5 of the assembly section 4 in the area surrounding the pin 2 is also damaged. This makes subsequent removal of the pin 2 for repeated toner cartridge assembly 1 refillings and remanufacturings more difficult and makes the assembly 1 look slopply and messed-up. Additionally, when the pin 2 is reinserted into the toner cartridge assembly 1 to hold the sections 3 and 4 together, it must be reinserted to such a depth so the pin 2 doesn't stick out too far and prevent the toner cartridge assembly I from fitting in the imaging machine. But the pin 2 must not be inserted so far into the assembly 1 that the pin 2 cannot be removed again. The same problems occur at each end of the toner cartridge assembly 1.

Figure 3:
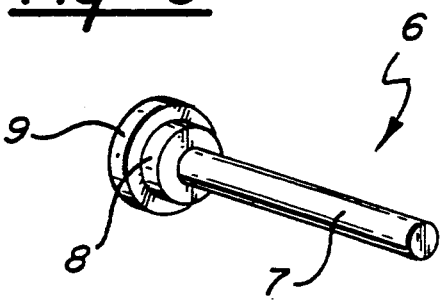
FIG. 3 shows the holding pin of this invention.

The improved holding pin 6 of this invention is shown (enlarged for clarity) in FIG. 3. The pin 6 has a shank 7 with a diameter and length sized to fit in the aligned passages of the first section 3 and second section 4 of the toner cartridge assembly 1 when the sections are put together. The holding pin 6 has a head comprising two portions. The first head portion 8 has a width or diameter larger than the shank 7 and is sized to abut against the wall 5 of the assembly section 4 when the shank 7 of the pin 6 is installed in the toner cartridge assembly 1. The second head portion 9 of the holding pin 6 has a width or diameter larger than the diameters or widths the first head portion 8 and the shank 7 of the pin 6. The first head portion 8 is located between the second head portion 9 and the shank 7. The head portions 8 and 9 are short in length so the head of the pin 6 does not interfere with fitting the toner cartridge assembly 1 into the imaging machine. The holding pin 6 is made of a strong, rigid metal or plastic.

Figure 4:
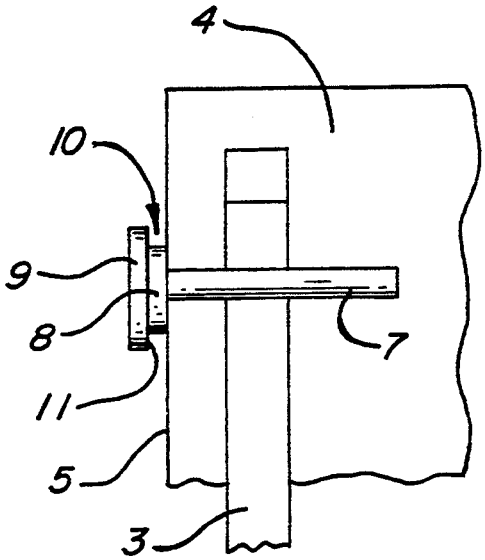
FIG. 4 illustrates how the holding pin of this invention is designed for easy removal from and insertion into the toner cartridge assembly.

As shown in FIG. 4, when the holding pin 6 is used to secure the two sections 3 and 4 of the toner cartridge assembly 1 together, the shank 7 is inserted completely into the assembly 1 such that the first head portion 8 of the pin 6 abuts against the wall 5 of the assembly section 4. This allows the pin 6 to be inserted to the exact desired depth needed to both secure the two sections 3 and 4 of the assembly 1 together and prevent the protruding head of the pin from interfering with fitting the cartridge assembly in the imaging machine.

Because the second head portion 9 of the pin 6 is larger in width or diameter than the first head portion 8, the second head portion 9 overhangs the first head portion 8, providing a space 10 between the second head portion 9 and the wall 5 of the assembly section 4. Therefore, a conventional gripping tool, such as a nipper tool or wire cutter, may be used to fit against the underside 11 of the second head portion 9 and easily pull the pin 6 from the assembly 1. In this way, the pin 6 may be easily and repeatedly inserted into or removed from the toner cartridge assembly 1 without damage to the pin 6 or the assembly 1. A pin 6 would be used at each end of the toner cartridge assembly 1.

Since minor changes and modifications varied to fit particular operating requirements and environments will be understood by those skilled in the art, the invention is not considered limited to the specific example chosen for purposes of illustration, and includes all changes and modifications which do not constitute a departure from the true spirit and scope of this invention as claimed in the following claims and reasonable equivalents to the claimed elements.

What is claimed is:

1. A holding pin for securing together sections of a toner cartridge assembly for use in imaging machines, said holding pin comprising a shank and a head larger diameter than said shank, said head having two portions, a first portion for abutting against said assembly and a second portion sized to allow easy gripping of said head for removal of said pin from said toner cartridge assembly.

2. An improved holding pin as in claim 1 wherein said shank has a length and a diameter sized to fit within said assembly and secure said sections together.

3. An improved holding pin as in claim 2 wherein said head is sized such that said head does not interfere with fitting said assembly into said imaging machines.

4. An improved holding pin as in claim 1 wherein said first portion of said head is smaller in width or diameter than said second portion of said head, such that said second portion overhangs said first portion and a space is provided between said second portion of said pin and said assembly when said pin is inserted into said assembly, allowing easy gripping of said head.

5. An improved holding pin as in claim 4 wherein said first portion of said head is located between said shank and said second portion of said head of said pin.

6. An improved holding pin as in claim 1 wherein said pin is made of metal.

7. An improved holding pin as in claim 1 wherein said pin is made of plastic.

8. An improved holding pin as in claim 1 wherein said assembly has two ends and said improved holding pin is used at each of said two ends of said assembly to secure said sections of said assembly together.

9. A holding pin for securing together sections of a toner cartridge assembly for use in imaging machines, said holding pin comprising a shank and a head larger diameter than said shank, said head having means for allowing easy gripping of said pin for removal from said toner cartridge assembly, said assembly having two ends and said improved holding pin being used at each of said two ends of said assembly to secure said sections of said assembly together.

* * * * *